US006557588B2

(12) United States Patent
Wright

(10) Patent No.: US 6,557,588 B2
(45) Date of Patent: May 6, 2003

(54) AGGREGATE RETAINING DEVICE FOR DRAIN COVERS

(75) Inventor: James R. Wright, Anaheim, CA (US)

(73) Assignee: Splash Pool Plastics, Inc., Yorba Linda, CA (US)

( * ) Notice: Subject to any disclaimer, the term of this patent is extended or adjusted under 35 U.S.C. 154(b) by 0 days.

(21) Appl. No.: 10/055,718

(22) Filed: Jan. 22, 2002

(65) Prior Publication Data

US 2002/0117225 A1 Aug. 29, 2002

Related U.S. Application Data

(63) Continuation of application No. 09/799,773, filed on Mar. 5, 2001, now Pat. No. 6,340,035, which is a continuation-in-part of application No. 09/452,766, filed on Dec. 1, 1999, now Pat. No. 6,209,586.

(51) Int. Cl.[7] ..... E04H 4/14
(52) U.S. Cl. ..... 138/96 R; 4/504; 4/507
(58) Field of Search ..... 138/96 R, 90; 4/496, 504, 507, 506; 210/162, 163

(56) References Cited

U.S. PATENT DOCUMENTS

| | | | | |
|---|---|---|---|---|
| 3,378,858 A | | 4/1968 | Jacuzzi | 4/507 X |
| 3,800,486 A | | 4/1974 | Harvey | 138/96 R |
| 3,829,910 A | | 8/1974 | Kaufman | 4/504 |
| 4,170,047 A | | 10/1979 | Corsette et al. | 4/293 |
| 4,658,449 A | | 4/1987 | Martin | 4/496 |
| 4,666,333 A | | 5/1987 | Armstrong | 404/26 |
| 4,957,268 A | | 9/1990 | Picollo et al. | 249/10 |
| 5,003,735 A | | 4/1991 | Bates | 138/96 R X |
| D333,342 S | | 2/1993 | Newhard | 4/507 |
| 5,268,096 A | | 12/1993 | Robol | 210/164 |
| 5,341,523 A | | 8/1994 | Barnes | 4/507 |
| D351,220 S | | 10/1994 | Barnes | D23/260 |
| 5,360,284 A | | 11/1994 | Allard | 404/2 |
| 5,734,999 A | | 4/1998 | Nicholas | 4/507 |
| 5,996,134 A | | 12/1999 | Senninger | 138/96 R X |
| 6,209,586 B1 | * | 4/2001 | Wright | 138/96 R |
| 6,340,035 B2 | * | 1/2002 | Wright | 138/96 R |

* cited by examiner

*Primary Examiner*—Patrick Brinson
(74) *Attorney, Agent, or Firm*—Knobbe, Martens, Olson & Bear, LLP

(57) ABSTRACT

An apparatus for and a method of forming a surface finish on a top surface of a drain cover for swimming pools or spas so that the surface finish of the drain cover matches the surface finish of the pool or spa. The apparatus comprises a ring shaped structure that is adapted to be positioned on the top surface of the drain cover wherein the ring is mounted along the general outer perimeter of the top surface of the drain cover. An exposed aggregate or plaster finish is then formed on the top surface of the cover enclosed by the ring so that the ring retains and shapes the surface finish.

16 Claims, 8 Drawing Sheets

AGGREGATE RETAINING DEVICE FOR DRAIN COVERS

RELATED APPLICATIONS

This application is a Continuation of U.S. patent application Ser. No. 09/799,773, filed Mar. 5, 2001, now U.S. Pat. No. 6,340,035, which was a Continuation-in-Part of U.S. patent application Ser. No. 09/452,766, filed Dec. 1, 1999, now U.S. Pat. No. 6,209,586, issued Apr. 3, 2001, entitled "AGGREGATE RETAINING DEVICE FOR DRAIN COVERS", which is hereby incorporated by reference.

BACKGROUND OF THE INVENTION

1. Field of the Invention

This invention relates to drain covers for swimming pools and spas, and more particularly to an apparatus for applying an exposed aggregate or plaster finish to the top surface of drain covers.

2. Description of the Related Art

Drain openings are typically formed on the bottom of most conventional swimming pools so that water can be removed from the pool and circulated through a filtration system. The openings generally extend through the floor of the pool and are connected to drain pipes that are configured to transport water from the pool to a filtering device. Furthermore, a recirculation pump is typically used to remove water from the pool through the drains, down the drain pipes, and into the filtration system wherein the water is filtered and cleaned before being transported back into the pool through the return lines.

Disadvantageously, however, the drain openings are generally unsightly and can pose as a safety hazard for swimmers. In particular, the suction created by the large volume of water passing through the drains is known to cause a whirlpool vortex wherein the force of the vortex can be strong enough to trap swimmers near the drains. Furthermore, it can be appreciated that a swimming pool tends to lose some of its aesthetic appeal when the floor of the pool is dotted with numerous drain openings. To address these problems, various anti-vortex drains and covers have been developed to reduce the suction around the drains while at the same time enhance the aesthetic appeal of the pool.

In particular, the standard drain cover currently used for most swimming pools is a circular anti-vortex drain cover. The cover is adapted to be positioned over a generally circular drain opening and comprises a top surface that is relatively flat and a plurality of side openings that serve as passage ways for water to flow from the pool into the drain opening. Furthermore, the cover is made from plastic material and is generally available only in a limited number of colors such as black, white, and shades of gray.

Consequently, the standard drain covers often do not match the surface finish of the swimming pool as the surface finish of the pools can be made from a wide variety of colors and textures. In particular, the standard drain covers will appear conspicuously out of place when set against the surface finish of swimming pools having a plaster or exposed aggregate finish wherein the color of the surface is custom blended to the taste of the pool owner. Likewise, the standard drain covers also appear undesirably conspicuous when they are positioned over drain openings formed on the bottom of spas that are decorated with a colored plaster or exposed aggregate finish.

To address this problem, drain cover assemblies have been created that are designed with the intent of making the cover less conspicuous and more uniform with the surface finish of the pool or spa. In particular, there are existing covers made from a clear plastic material wherein the transparency of the plastic is likely to make the cover less noticeable and allow the cover to blend in with the surface finish of the pool or spa. Disadvantageously, however, the transparent covers do not properly conceal the drain pipes underneath the covers and therefore leave the unsightly pipes exposed to plain view. It can be appreciated that visible drain pipes on the bottom of a swimming pool or spa are sometimes even more unappealing than drain covers that do not match the color and texture of the surface finish of the pool.

Hence, from the foregoing, it will be appreciated that there is a need for a drain cover for swimming pools or spas that is less conspicuous. To this end, there is a particular need for an apparatus or a method for matching a drain cover to the surrounding surface.

SUMMARY OF THE INVENTION

The aforementioned needs are satisfied by the apparatus of the present invention, which provides a drain cover having an exposed aggregate or plaster surface finish and adapted to be positioned over a drain opening. In one aspect, the apparatus comprises a drain cover having an upper surface and a side surface wherein the side surface includes at least one opening permitting fluid communication therethrough to the drain opening. Furthermore, a section of the upper surface is recessed so as to define a cavity region wherein the cavity region is configured to retain aggregate material so as to provide the upper surface of the drain cover with an aggregate finish.

In one embodiment, the cavity is approximately between ⅜ to ½ inch deep and extends from the center of the upper surface to the outer perimeter of the upper surface. Preferably, the cavity region is defined by a sidewall that extends outward from the plane of the upper surface while simultaneously extending inward towards the center of the upper surface. In another embodiment, the drain cover is formed of a clear material so that it is camouflaged by the aggregate material. Preferably, the drain cover is circular in shape to match most conventional drain openings, however it can be appreciated that the drain cover can take on a variety of other shapes without departing from the spirit of the invention.

In another aspect, the apparatus comprises a retaining device adapted to retain aggregate material on an upper surface of a drain cover. The retaining device comprises a frame that is adapted to be positioned adjacent the upper surface of the drain cover. Preferably, the frame has a sidewall that is configured to extend about the outer perimeter of the upper surface of the drain cover and defines a cavity in which the aggregate material can be positioned. Preferably, the sidewall exerts a force against the aggregate material to retain the aggregate material in the cavity adjacent the upper surface of the drain cover.

Furthermore, the sidewall of the retaining device extends outward from the plane of the upper surface of the drain cover while simultaneously extending inward towards the center of the upper surface of the drain cover. Preferably, the sidewall is approximately ⅜ to ½ inch high. Preferably, the retaining device is formed of a clear material so that the aggregate material is visible through the retaining device to thereby camouflage the retaining device.

In another embodiment, the retaining device further comprises at least one reinforcing member that extends across the cavity defined by the sidewall of the retaining device. Preferably, the at least one reinforcing member is coupled to an inner surface of the sidewall of the retaining device so as to increase the structural rigidity of the retaining device. In one embodiment, the frame is substantially circular in shape; however, the frame may take on a variety of other shapes without departing from the scope of the invention.

Furthermore, the retaining device also includes at least one mounting member adapted to secure the retaining device to a mounting surface. In one embodiment, the mounting member is adapted to secure the retaining device to the bottom of a pool adjacent a pool drain, while in another embodiment, the mounting member is adapted to secure the retaining device to the drain cover. In another embodiment, the retaining device further comprises at least one reinforcing member that extends across the cavity defined by the sidewall of the retaining device. Preferably, the at least one reinforcing member is coupled to an inner surface of the sidewall of the retaining device so as to increase the structural rigidity of the retaining device.

In yet another aspect, the apparatus of the present invention provides a drain cover adapted to be positioned over a drain opening in a pool wherein the drain cover comprises an upper surface and a side surface. Preferably, the side surface includes at least one opening permitting fluid communication therethrough to the drain opening. Furthermore, a sidewall is positioned adjacent the upper surface of the drain cover and extends about the outer perimeter of the outer surface as to define a cavity region wherein the cavity region is configured to retain aggregate material so as to provide the upper surface of the drain cover with an aggregate finish.

Advantageously, the apparatus of the present invention retains the aggregate material on the upper surface of the drain cover so as to give the drain cover the same color and texture as the aggregate. In contrast to the conventional drain covers that are available in only a selected number of colors, the drain cover of the present invention can be easily made into a wide variety of colors and textures to match the surface finish of the swimming pool and thereby improve the aesthetic appeal of the pool.

DETAILED DESCRIPTION OF THE PREFERRED EMBODIMENT

Reference will now be made to the drawings wherein like numerals refer to like parts throughout. As will be described hereinbelow, the apparatus of the preferred embodiment provides a means of applying a plaster or exposed aggregate surface finish onto a top surface of a drain cover for swimming pools or spas.

Figure 1:
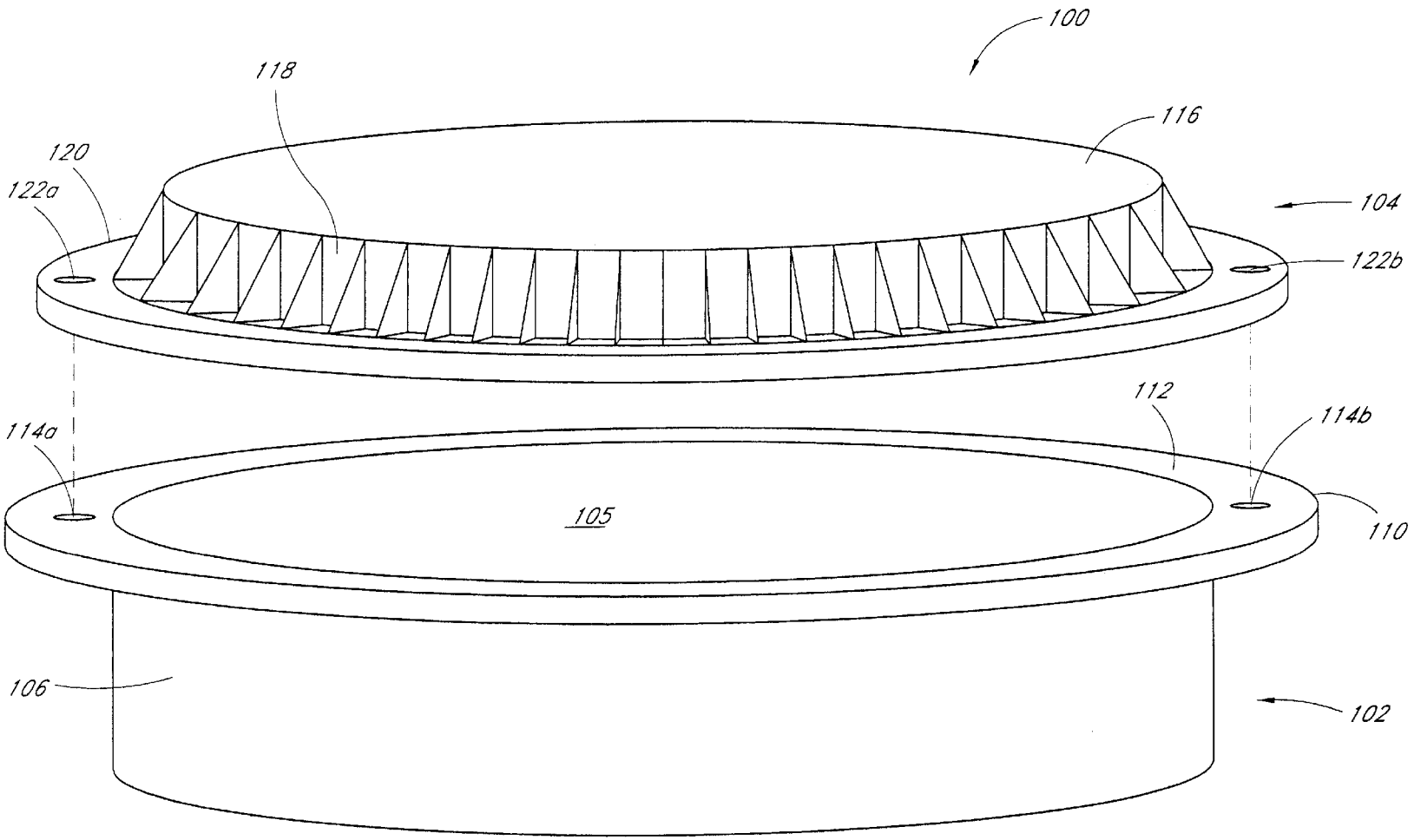
FIG. 1 is a general perspective view of one embodiment of a conventional drain cover assembly for swimming pools and spas.

FIG. 1 shows an embodiment of a conventional anti-vortex drain cover assembly 100 that is commonly used to cover drain openings of swimming pools and spas. As FIG. 1 illustrates, the drain cover assembly 100 is generally circular in shape and comprises a base 102 and a cap 104 wherein the cap 104 is mounted onto the base 102 in a well known manner. Furthermore, the base 102 is generally ring-shaped and comprises a side wall 106 defining an outer perimeter of the base 102. The base member 102 also defines a central opening 105. The side walls 106 of the base member 102 are typically positioned within a drain opening in the pool or spa such that water can flow through the central opening 105 into the drain.

Preferably, a lip 110 extends perpendicularly outward from an upper edge of the side wall 106 so as to create a mounting surface 112 for the cap 104. Furthermore, a plurality of first openings 114*a*, 114*b* are formed on the mounting surface 112 wherein the openings 114*a*, 114*b* are configured to receive a plurality of mounting screws that are typically used to affix the cap 104 to the base 102.

As FIG. 1 further illustrates, the cap 104 of the cover assembly 100 is also generally circular in shape and comprises an upper surface 116, a bottom rim 120, and a plurality of side openings 118 designed for water to pass through. In particular, the bottom rim 120 of the cap 104 is adapted to rest on the mounting surface 112 of the base 102 when the cap 104 is mounted to the base 102. Furthermore, the bottom rim 120 comprises a plurality of second openings 122*a*, 122*b* that are configured to align with the corresponding first openings 114*a*, 114*b* on the mounting surface 112 so that a mounting screw or other fastener can be inserted into each pair of aligned openings so as to secure the top cover 104 onto the base 102.

In one embodiment, the cover assembly 100 can be installed over a drain opening by positioning the ring-like base 102 around the drain in a manner such that the side wall 106 of the base 102 is completely imbedded in the surrounding concrete while the lip 110 of the base 102 remains above ground and encircles the drain opening. Preferably, the cap 104 is then mounted onto the base 102 via screws or other types of fasteners so that the drain opening is effectively concealed by the cap 104 while water from the pool is directed to flow through the side openings 118 of the cap 104 and down the drain.

Typically, the upper surface 116 of the cover is open to plain view when the cover assembly 100 is installed in a pool. It is therefore desirable to select drain covers with colors that substantially match the surface finish of the pool in order to preserve the overall aesthetic appeal of the pool. However, drain cover assemblies known in the art are typically available in only a limited number of colors such as black, white, or gray. Consequently, drain covers installed in most swimming pools do not match the surface finish of the pool as it is economically impractical to paint each drain cover in a color that matches the surface finish of a particular pool. Moreover, the standard drain covers are known to appear especially out of place when installed in swimming pools having an exposed aggregate finish wherein the color of the aggregate is custom blended.

As will be described in greater detail below, the drain cover of the illustrated embodiment provides a novel apparatus for and method of eliminating the color mismatch between the drain covers and the surface finish of swimming pools. In particular, the preferred embodiment provides an aggregate retaining device wherein the device is mounted on the drain cover and enables the top surface of the drain cover to be coated with a plaster or an exposed aggregate finish wherein the color and texture of the finish is substantially identical to the particular surface finish of the pool. In contrast to the conventional drain covers known in the art, the present invention provides a drain cover that is camouflaged in substantially the same color and texture as the surface finish of the swimming pool or spa so as to enhance the aesthetic appeal of the pool or spa.

Figure 2A:
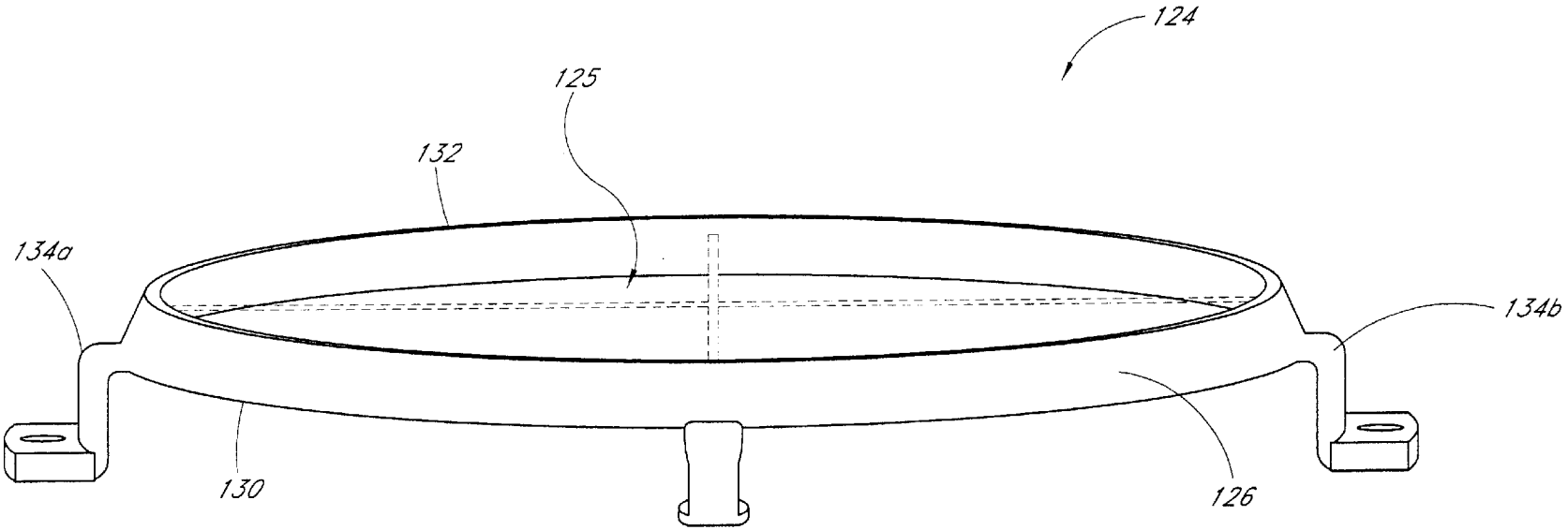
FIG. 2A is a general perspective view of one embodiment of an aggregate retaining device of the present invention.

With reference to FIG. 2A, a perspective view of an aggregate retaining device 124 of the preferred embodiment is shown. As is illustrated in FIG. 2A, the aggregate retaining device 124 is a generally ring shaped structure that is mounted adjacent the upper surface 116 of the drain cover 100 in a manner to be described in greater detail below. Preferably, the device 124 comprises a sidewall 126 wherein the sidewall 126 defines a generally circular opening 125. Furthermore, the device 124 is dimensioned so that its sidewall 126 is mounted adjacent the outer perimeter of the upper surface 116 of the drain cover 100 and extend upward from the plane of the upper surface 116 so as to form a cavity adjacent the upper surface 116. As will be described in greater detail below, the cavity is subsequently filled with an aggregate material wherein the aggregate material is retained within the cavity by the side wall 126.

As FIG. 2A further illustrates, the side wall 126 of the retaining device 124 is also configured to slope inwardly toward the center of the opening 125 as it extends outward from the plane of the upper surface 116. The inwardly sloped side wall 126 is more effective in mechanically retaining the aggregate and preventing the aggregate from being displaced. While the preferred embodiment describes a generally circular aggregate retaining device, the device can assume a variety of other shapes without departing from the scope of the invention.

As is also shown in FIG. 2A, the retaining device 124 further comprises a plurality of mounting brackets 134*a*, 134*b* wherein each bracket is a generally Z-shaped structure that is dimensioned to affix the retaining device 124 to the cover assembly 100. In particular, a first end 136*a*, 136*b* of the bracket 134*a*, 134*b* is attached to the side wall 126 while a second end 140*a*, 140*b* of the device 124 is configured to rest on the rim 120 of the cover assembly 100. Preferably, the second end 140*a*, 140*b* is a positioned horizontally over the second opening 122*a*, 122*b* on the rim 120 of the cap 104 so that a third opening 142*a*, 142*b* formed on the second end 140*a*, 140*b* of the bracket 134*a*, 134*b* aligns with the second opening 122*a*, 122*b* on the rim 120 of the cover assembly 100. Preferably, a mounting screw or fastener is inserted into the aligned openings so as to secure the retaining device 124 onto the cover assembly 100. Advantageously, the aggregate retaining device 124 can be easily mounted onto a conventional standard drain cover by utilizing existing mounting holes on the cover. However, it can be appreciated that different types of fastening devices can be used to mount the aggregate retaining device 124 onto the cover assembly 100 in other embodiments of the present invention.

As FIG. 2A further shows, a plurality of reinforcing members 144*a*, 144*b* is positioned across the opening 125 of the aggregate retaining device 124 so as to provide structural support in a manner to be described in greater detail below. FIG. 2 shows each reinforcing member 144*a*, 144*b* extending across a diameter of the opening 125 in a manner so as to form a generally cross-shaped configuration. Furthermore, the plane defined by the reinforcing members 144*a*, 144*b* is slightly recessed from the plane defined by the top edge of the aggregate retaining device 124. Preferably, the reinforcing members 144*a*, 144*b* are designed to rest in the aggregate material inside the cavity defined by the opening 125 so as to mechanically reinforce the aggregate material such that people standing on the drain in the pool are less likely to damage or crack the aggregate material.

Furthermore, a plurality of clips 146*a*, 146*b* are formed in a well known manner on the bottom surface 130 of the retaining device 124 wherein the clips 146*a*, 146*b* are designed to engage an outer edge 138 of the top surface of the cover assembly 100 so as to further secure the retaining device 124 onto the cover assembly 100. While the aggregate retaining device 124 of the preferred embodiment is adapted for an anti-vortex drain cover, it can be appreciated that the retaining device 124 can be configured for a wide variety of other types of drain covers without departing from the scope of the invention.

Figure 2B:
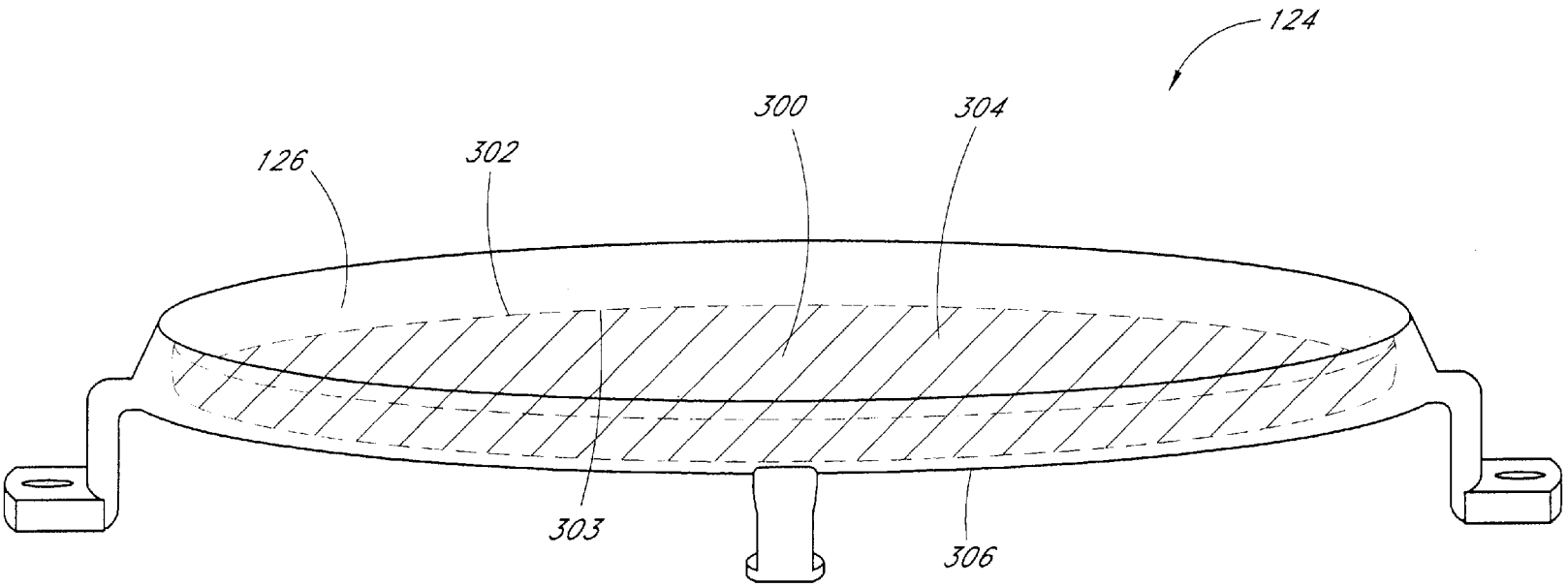
FIG. 2B is a general perspective view of another embodiment of the aggregate retaining device of FIG. 2A.

FIG. 2B illustrates another embodiment of the aggregate retaining device of the present invention. As shown in FIG. 2B, the retaining device 124 further comprises a bottom member 300 that is connected to a lower edge 302 of the side wall 126. In particular, the side wall 126 extends upwardly from an outer edge 302 of the bottom member 300 so as to retain the aggregate material that will be placed on an upper surface 304 of the bottom member 300. Furthermore, a lower surface 306 of the bottom member is adapted to be positioned adjacent an upper surface of a conventional drain cover. In this embodiment, the aggregate material can be preformed in the retaining device 124 prior to placing the retaining device on the upper surface of the drain cover.

Figure 3:
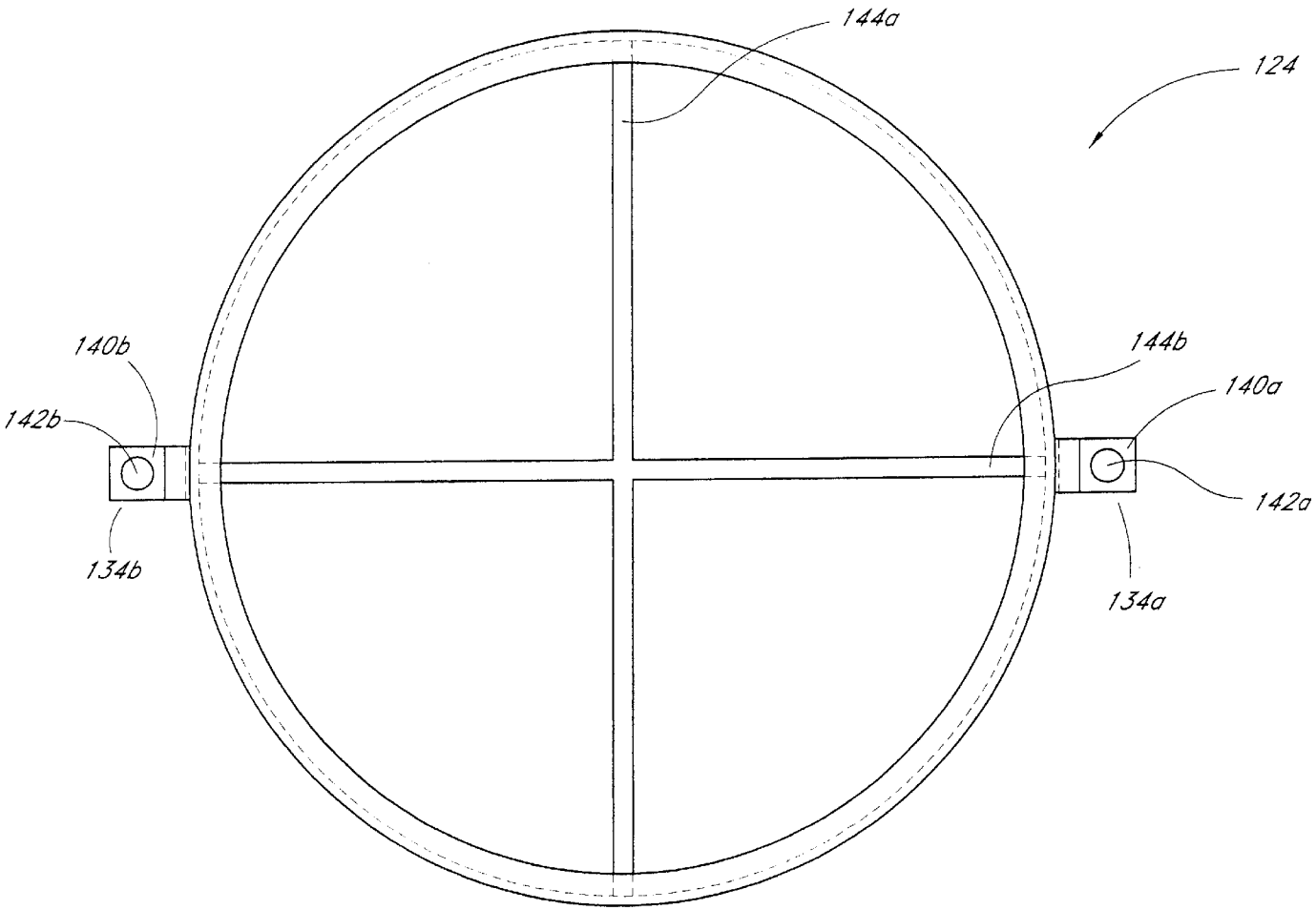
FIG. 3 is a top down view of the aggregate retaining device of FIG. 2.

FIG. 3 illustrates a top down view of the above described aggregate retaining device 124. As FIG. 3 illustrates, the aggregate retaining device 124 of the illustrated embodiment is generally circular in shape and comprises two mounting brackets 134*a*, 134*b* that are attached to the outer surface of the retaining device 124 and positioned diametrically across from each other. Furthermore, FIG. 3 shows the second end 140*a*, 140*b* of the device having the openings 142*a*, 142*b* configured for mounting screws.

Figure 4:
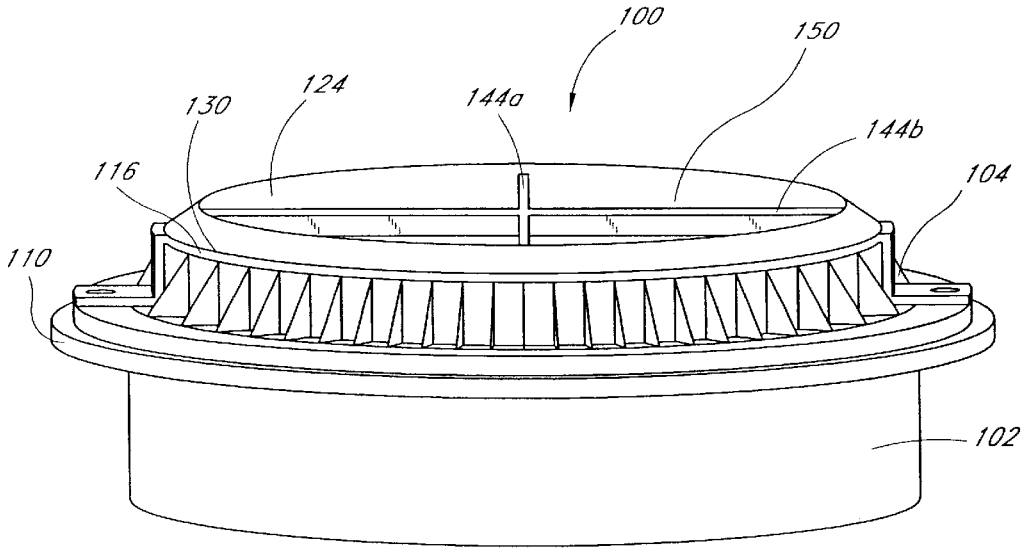
FIG. 4 is a general perspective view of the aggregate retaining device of FIG. 2 mounted on the drain cover assembly of FIG. 1.

FIG. 4 illustrates a general perspective view of the above described aggregate retaining device 124 mounted on the drain cover assembly 100 of the preferred embodiment. As is shown in FIG. 4, the bottom surface 130 of the retaining device 124 rests adjacent the outer perimeter of the upper surface 116 of the cover assembly 100 so as to define a cavity 150 that will be filled with aggregate material. Preferably, the device 124 is fixedly attached to the cover assembly 100 via mounting screws or fasteners as described in detail above. As it is shown above, the aggregate retaining device 124 is simple to implement as it is designed to utilize existing parts on a standard drain cover and does not require additional tools or processing. While the device of the present invention is adaptable to any drain cover having a general top surface, the device can also be made as an integral part of a drain cover assembly in other embodiments of the invention.

Figure 5:
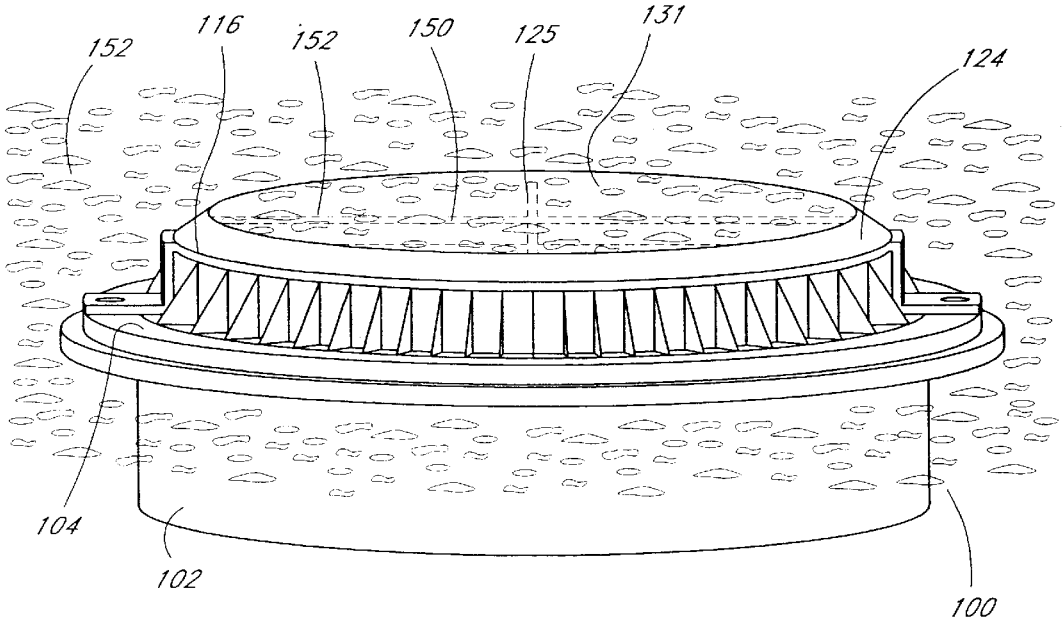
FIG. 5 is the drain cover assembly of FIG. 4 having an exposed aggregate surface formed on a top surface of the drain cover.

FIG. 5 shows the drain cover assembly 100 of the present invention wherein its top surface is coated with a plaster or aggregate finish. As is shown in FIG. 5, an aggregate material is filled into the cavity 150 created by the retaining device 124, using tools and techniques that are well known in the art. In particular, the aggregate material used is substantially identical to the surface finish 152 of the pool. As is shown in FIG. 5, the top surface of the cover assembly is thus made to resemble the pool surface in color and texture.

The aggregate retaining device 124 retains the aggregate material as a result of the aggregate material being positioned adjacent the upper surface 116 of the cover 104 and the outer perimeter of the aggregate material being positioned underneath the inner surfaces 131 of the ring 124. As discussed above, the inner surfaces 131 of the ring 124 are preferably angled inward towards the center of the opening 125. Hence the inner surfaces 131 exert a downward force against the outer perimeter of the aggregate material 152. When the aggregate material 152 dries in the cavity 150, the bonding between the aggregate material results in the aggregate material being essentially a solid mass. Since the outer perimeter of the aggregate material 152 is captured by the inner surfaces 131 of the ring 124 against the upper surface 116 of the cover 104, the aggregate material 152 is retained adjacent the upper surface 116 of the cover 104.

In one embodiment, the cover assembly 100 and the aggregate retaining device are made from a clear plastic material such as polycarbonate. The clear material camouflages the aggregate retaining device 124 so that only the aggregate surface of the cover is visible. As FIG. 5 illustrates, the drain cover 100 with an aggregate finish on the top is not conspicuous and conform with the surface finish of the pool. Furthermore, the device provides a convenient way for the user to apply the aggregate surface so that the drain covers can be made to any type of plaster or exposed aggregate finish.

Figure 6:
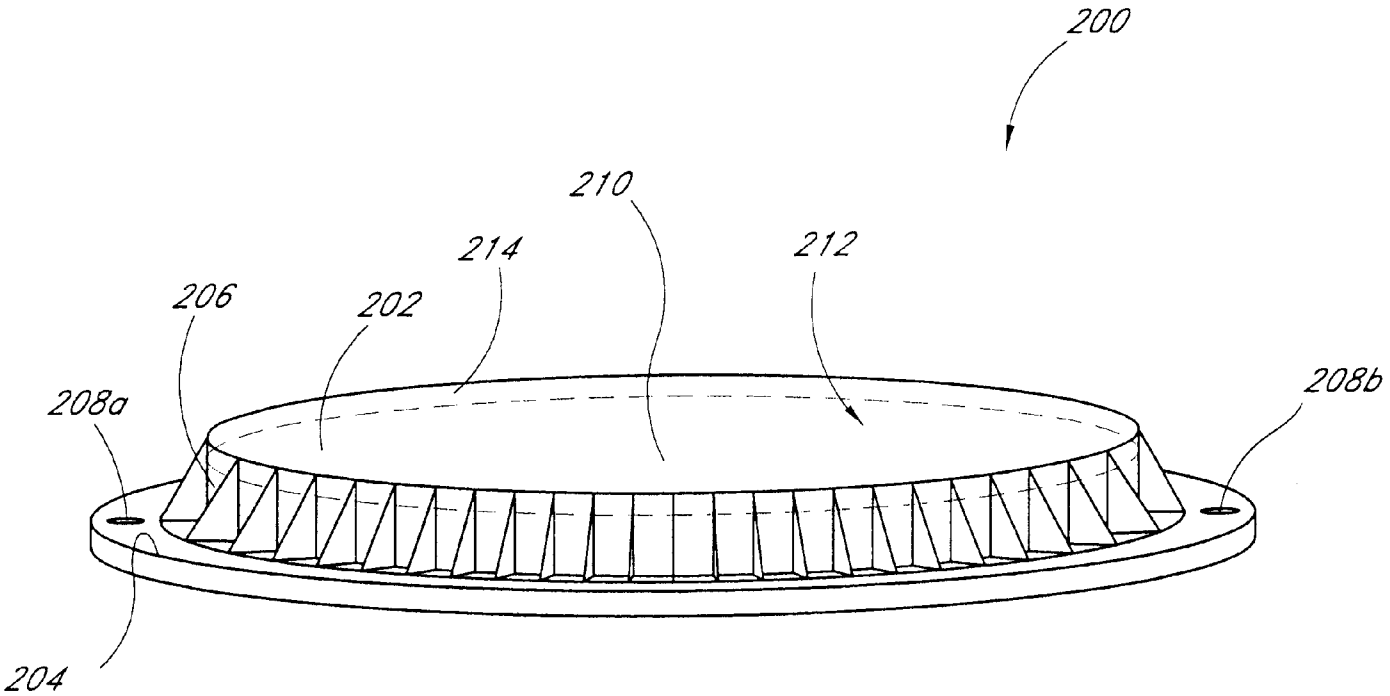
FIG. 6 is a general perspective view of another embodiment of a drain cover assembly of the present invention.

FIG. 6 is a general perspective view of another embodiment of the drain cover of the present invention. As FIG. 6 illustrates, the drain cover 200 is generally circular in shape and comprises an upper surface 202, a bottom rim 204, and a plurality of side openings 206 designed for water to pass through. Preferably, the bottom rim 204 has a plurality of second openings 208*a*, 208*b* that are configured to screw mount the drain cover to various mounting surfaces. In one embodiment, the drain cover 200 can be mounted on the bottom of a pool adjacent to a drain opening, while in another embodiment, the drain cover 200 can be mounted to a base member assembly as described above in detail. Although the drain cover of the preferred embodiment utilizes a screw mounting mechanism, it can be appreciated that other mounting methods can also be used to attach the drain cover to a mounting surface.

As FIG. 6 further shows, a section 210 of the upper surface 202 of the drain cover 200 is recessed so as to define a cavity region 212 therein. The cavity region 212 is configured to retain aggregate material so as to provide the upper surface 202 of the drain cover with an aggregate finish. Preferably, the cavity region 212 is approximately between ⅜ to ½ inch deep so as to minimize the amount of aggregate material needed to fill the cavity region. In one embodiment, the cavity region 212 is defined by a sidewall 214 that extends outward from the plane of the upper surface 202 while simultaneously extending inward towards the center of the upper surface 202. The sidewall 214 exerts a force against the aggregate material to retain the aggregate material in the cavity region 212 adjacent the upper surface 202 of the drain cover 200. Preferably, the drain cover 200 is formed of a clear material so that it is camouflaged by the aggregate material.

Figure 7:
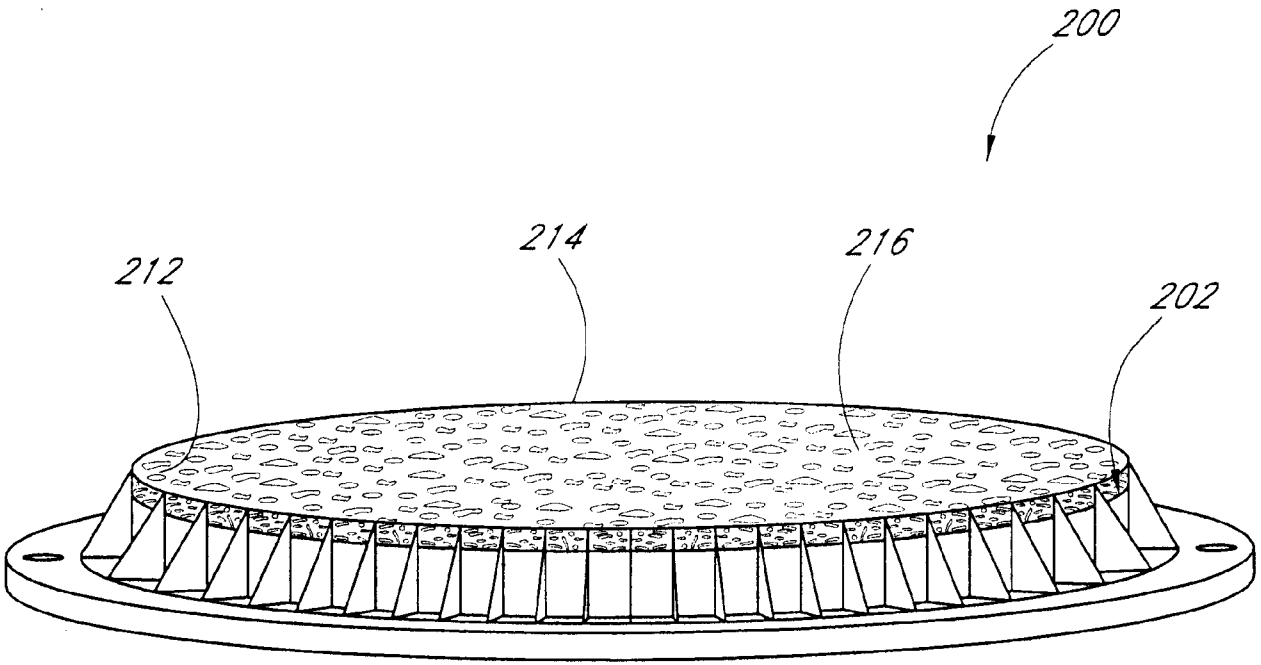
FIG. 7 is the drain cover assembly of FIG. 6 having an exposed aggregate surface formed on a top surface of the drain cover.
Figure 8:
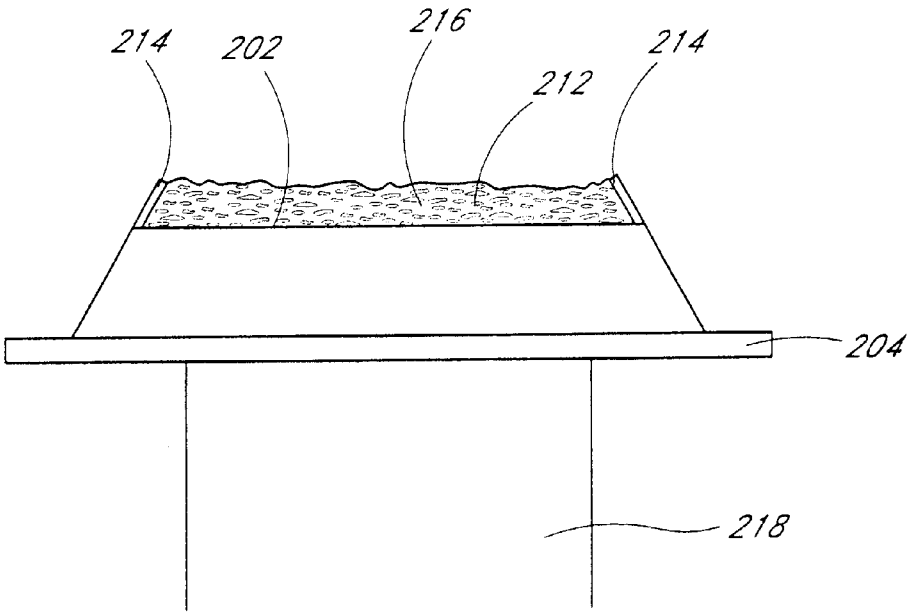
FIG. 8 is a schematic cross-sectional view of the drain cover assembly of FIG. 7.

FIG. 7 shows the upper surface 202 of the drain cover 200 covered with an aggregate or plaster finish 214. As FIG. 7 illustrates, the aggregate material 216 is retained in the cavity region 212 created by the recess in the upper surface 202 of the drain cover 200. Preferably, the aggregate material used is substantially identical to the surface finish of the pool. FIG. 8 is a schematic cross-sectional view of the drain cover 200 covered with the aggregate material 216 and placed over a conventional drain opening 218. As FIG. 8 shows, the sidewall 214 extends inward toward the center of the upper surface 202 so as to exert a force against the aggregate material 216 to retain the aggregate material 216 in the cavity region 212. As such, the upper surface of the drain cover is made to resemble the pool surface finish in color and texture so as to camouflage the drain opening 218 and thus provide the pool with a more uniform appearance.

Although the foregoing description of the preferred embodiment of the present invention has shown, described and pointed out the fundamental novel features of the invention, it will be understood that various omissions, substitutions, and changes in the form of the detail of the apparatus as illustrated as well as the uses thereof, may be made by those skilled in the art, without departing from the spirit of the invention. Consequently, the scope of the invention should not be limited to the foregoing discussions, but should be defined by the appended claims.

What is claimed is:

1. A drain cover adapted to be positioned over a drain opening in a pool wherein the drain cover comprises an upper surface and a side surface wherein the side surface includes at least one opening permitting fluid communication therethrough to the drain opening, wherein a section of the upper surface is recessed so as to define a cavity regions wherein a layer of aggregate material is positioned adjacent the cavity region in a manner so as to provide the drain cover with the appearance of having an aggregate finish.

2. The drain cover of claim 1 wherein the cavity region has a depth of approximately ⅜ to ½ inch.

3. The drain cover of claim 1 wherein the cavity region extends from the center of the upper surface to the outer perimeter of the upper surface of the drain cover.

4. The drain cover of claim 1 wherein the upper surface of the drain cover is substantially circular.

5. The drain cover of claim 1 wherein the cavity region has a sidewall that extends outward from the plane of the upper surface while simultaneously extending inward towards the center of the upper surface.

6. The drain cover of claim 1 wherein the drain cover is formed of a clear material so that the drain cover is camouflaged by the aggregate material.

7. A retaining device that retains aggregate material adjacent an upper surface of a drain cover, wherein the retaining device comprises a lower surface and a frame that is adapted to be positioned adjacent the upper surface of the drain cover wherein the frame has a sidewall that extends about the outer perimeter of the lower surface and defines a cavity in which the aggregate material can be positioned, wherein the sidewall exerts a force against the aggregate material to retain the aggregate material in the cavity, wherein the retaining device is positioned adjacent the upper surface of the drain cover in a manner such that the aggregate material is positioned adjacent the upper surface of the drain cover.

8. The retaining device of claim 7 wherein the sidewall extends outward from the plane of the upper surface of the drain cover while simultaneously extending inward towards the center of the upper surface of the drain cover.

9. The retaining device of claim 7 wherein the sidewall is approximately ⅜ to ½ inch high.

10. The retaining device of claim 7 further comprises a bottom member that is connected to the side wall of the frame in a manner such that the side wall extends upwardly from an outer edge of the bottom member so as to retain the aggregate material that is placed on an upper surface of the bottom member.

11. The retaining device of claim 7 wherein the retaining device is formed of a clear material so that the aggregate material is visible through the retaining device to thereby camouflage the retaining device.

12. The retaining device of claim 7 further comprises at least one reinforcing member that extends across the cavity defined by the sidewall of the retaining device wherein the at least one reinforcing member is coupled to an inner surface of the sidewall of the retaining device so as to increase the structural rigidity of the retaining device.

13. The retaining device of claim 7 further comprises at least one mounting member that secures the retaining device to a mounting surface.

14. The retaining device of claim 12 wherein the at least one mounting member secures the retaining device to the drain cover.

15. The retaining device of claim 12 wherein the at least one mounting member secures the retaining device to the bottom of a pool adjacent a pool drain.

16. The retaining device of claim 7 wherein the frame has a substantially circular shape.

* * * * *

UNITED STATES PATENT AND TRADEMARK OFFICE

CERTIFICATE OF CORRECTION

PATENT NO. : 6,557,588 B2
DATED : May 6, 2003
INVENTOR(S) : James R. Wright

It is certified that error appears in the above-identified patent and that said Letters Patent is hereby corrected as shown below:

Column 8,
Line 31, please delete “regions”, and insert therfore, -- region --.

Signed and Sealed this

Sixth Day of July, 2004

JON W. DUDAS
*Acting Director of the United States Patent and Trademark Office*